US010407965B2

(12) United States Patent
Alford et al.

(10) Patent No.: US 10,407,965 B2
(45) Date of Patent: Sep. 10, 2019

(54) CAM LOCKING SHOTGUN GATE

(71) Applicant: Universal City Studios LLC, Universal City, CA (US)

(72) Inventors: Robert Louis Alford, West Columbia, SC (US); Michael Richard Mehlhorn, Clermont, FL (US)

(73) Assignee: Universal City Studios LLC, Universal City, CA (US)

( * ) Notice: Subject to any disclaimer, the term of this patent is extended or adjusted under 35 U.S.C. 154(b) by 100 days.

(21) Appl. No.: 15/665,077

(22) Filed: Jul. 31, 2017

(65) Prior Publication Data

US 2018/0179801 A1 Jun. 28, 2018

Related U.S. Application Data

(60) Provisional application No. 62/438,046, filed on Dec. 22, 2016.

(51) Int. Cl.

| | |
|---|---|
| ***E01F 13/00*** | (2006.01) |
| ***E05F 15/611*** | (2015.01) |
| ***E06B 11/02*** | (2006.01) |
| ***E06B 11/04*** | (2006.01) |
| ***E05F 15/53*** | (2015.01) |
| *E05F 15/63* | (2015.01) |
| *E06B 11/08* | (2006.01) |

(52) U.S. Cl.

CPC ..... *E05F 15/611* (2015.01); *E05F 15/53* (2015.01); *E06B 11/022* (2013.01); *E06B 11/04* (2013.01); *E05F 2015/631* (2015.01); *E05Y 2201/264* (2013.01); *E05Y 2201/604* (2013.01); *E05Y 2201/612* (2013.01); *E05Y 2201/624* (2013.01); *E05Y 2201/638* (2013.01); *E05Y 2201/64* (2013.01); *E05Y 2201/684* (2013.01); *E05Y 2800/296* (2013.01); *E05Y 2900/40* (2013.01); *E06B 11/085* (2013.01)

(58) Field of Classification Search

CPC ..... E05F 15/53; E05F 15/611; E06B 11/04; E06B 11/022; E06B 11/085; E05Y 2900/40; E05Y 2201/638; E05Y 2015/631

USPC ..... 49/49

See application file for complete search history.

(56) References Cited

U.S. PATENT DOCUMENTS 683,887 A * 10/1901 Bedell ..... A47C 17/86 16/288

2,637,921 A 5/1953 Lein (Continued)

FOREIGN PATENT DOCUMENTS

| | | |
|---|---|---|
| DE | 19524552 | 1/1997 |
| EP | 0190228 | 8/1986 |

(Continued)

OTHER PUBLICATIONS

PCT/US2017/066479 International Search Report and Written Opinion dated Mar. 29, 2018.

*Primary Examiner* — Jerry E Redman

(74) *Attorney, Agent, or Firm* — Fletcher Yoder P.C.

(57) ABSTRACT

A gate system includes a cam sled having a cam plate configured to slide along a rail. The gate system also includes a cam follower engaged with the cam plate and coupled to a gate assembly. Actuation of a power source to move the cam sled along the rail causes the gate assembly to rotate about an axis and mechanically lock into position in open or closed orientations of the gate assembly.

20 Claims, 9 Drawing Sheets

(56) References Cited

U.S. PATENT DOCUMENTS 2,743,125 A 4/1956 Wagner
3,381,412 A 5/1968 Brotherson
3,435,557 A 4/1969 Johnson
3,708,915 A 1/1973 Davey
3,758,990 A * 9/1973 Balanos ..... B60J 5/047 16/370
3,854,243 A 12/1974 Walker
3,854,244 A 12/1974 Walker
4,145,842 A 3/1979 Clugston
4,294,039 A * 10/1981 Dalheimer ..... E05D 3/16 296/76
4,458,448 A 7/1984 Proulx
4,854,010 A * 8/1989 Maraghe ..... B64C 1/1407 16/360
5,195,796 A * 3/1993 Wampler, II ..... E05D 3/18 16/358
5,367,829 A 11/1994 Crossley et al.
5,396,732 A 3/1995 Andersen
6,149,222 A * 11/2000 Schambre ..... E05D 3/10 16/334
6,308,650 B1 * 10/2001 Tsumiyama ..... B63B 19/14 114/55.53
6,370,732 B1 * 4/2002 Yezersky ..... E05C 17/203 16/82
6,382,705 B1 * 5/2002 Lang ..... B60J 5/0479 296/146.12
6,460,222 B2 * 10/2002 Je ..... E05C 17/32 16/357
6,513,193 B1 * 2/2003 Yezersky ..... E05C 17/203 16/86 A
6,646,536 B2 11/2003 Mori et al.
6,647,592 B2 * 11/2003 Presley ..... E05D 3/145 16/288
6,711,857 B1 3/2004 Wagnitz et al.
6,754,990 B2 6/2004 Pedemonte
6,845,589 B1 1/2005 Thompson et al.
6,851,159 B1 * 2/2005 Nikolic ..... E05D 11/1042 16/308
7,007,427 B2 3/2006 Sanke et al.
7,334,624 B2 2/2008 Waldman et al.
7,596,831 B2 * 10/2009 Faubert ..... E05D 3/18 16/287
7,765,740 B2 * 8/2010 Heuel ..... B60J 5/062 296/146.12
8,424,955 B2 * 4/2013 Heuel ..... B60J 5/06 296/155
8,434,197 B2 * 5/2013 Oshima ..... E05D 3/186 16/241
8,453,298 B2 * 6/2013 Nichols ..... E05D 3/127 16/366
8,733,017 B2 5/2014 Marsden et al.
9,482,052 B2 11/2016 Sousa et al.
2010/0115843 A1 5/2010 Gallenschuetz
2011/0067309 A1 3/2011 Hofmann et al.
2013/0212950 A1 8/2013 Bertsch et al.
2014/0318018 A1 10/2014 Huang
2015/0041075 A1 2/2015 Henderson
2015/0084347 A1 3/2015 Olsson et al.
2015/0101253 A1 4/2015 Marsden et al.
2015/0115623 A1 4/2015 Olsson et al.

FOREIGN PATENT DOCUMENTS

EP 1170437 1/2002
EP 1655433 5/2006
FR 2628468 9/1989
FR 2644507 9/1990
FR 2721973 1/1996
FR 2861124 4/2005
FR 2861126 4/2005
FR 2862335 5/2005
FR 2873744 2/2006
FR 2877987 5/2006
GB 452783 8/1936
GB 912244 12/1962
GB 2267725 12/1993
GB 2423327 8/2006
GB 2458893 10/2009
JP H0584799 U 11/1993
JP H07293089 11/1995
JP H10102959 4/1998
JP 2869885 3/1999
JP 3651149 5/2005
JP 4023147 12/2007
JP 4023149 12/2007
JP 4023158 12/2007
JP 4374318 12/2009
JP 4857209 1/2012
JP 5296576 9/2013
JP 2014109177 6/2014
JP 5764019 8/2015
WO 2014194357 12/2014

* cited by examiner

CAM LOCKING SHOTGUN GATE

CROSS-REFERENCE TO RELATED APPLICATION

This application claims priority to and the benefit of U.S. Provisional Application No. 62/438,046 entitled "CAM LOCKING SHOTGUN GATE," filed Dec. 22, 2016, which is hereby incorporated by reference in its entirety for all purposes.

FIELD OF DISCLOSURE

The present disclosure relates generally to gating systems, and more particularly, to shotgun gating systems.

BACKGROUND

Theme park or amusement park ride attractions have become increasingly popular. In some cases, gate systems are used to control crowd flow and access to such attractions. Some gate systems may include gates that are manually opened and closed by a guest or operator, and some gate systems may employ actuators (e.g., hydraulic actuators) as power sources to generate a force to open and close the gates. In some cases, the actuators that control the gates may be large and/or there may be high force requirements for holding the gates in certain positions (e.g., open, closed, or partially open) and/or actuating the gates (e.g., opening and closing), for example.

BRIEF DESCRIPTION

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In an embodiment, a gate system includes a cam sled having a cam plate configured to slide along a rail. The gate system also includes a cam follower engaged with the cam plate and coupled to a gate assembly. Actuation of a power source to move the cam sled along the rail causes the gate assembly to rotate about an axis and mechanically lock into position in open or closed orientations of the gate assembly.

In an embodiment, a gate system includes a cam plate having a guide element and configured to slide along a rail. The gate system also includes a cam follower configured to follow the guide element as the cam plate slides along the rail. The gate system further includes a gate assembly coupled to the cam follower. Movement of the cam plate along the rail causes the gate assembly to rotate between an open position to enable access through the gate assembly and a closed position to block access through the gate assembly.

In an embodiment, a gate system includes a cam plate having a guide element and configured to slide along a rail between a first end position and a second end position. The guide element includes a generally v-shaped profile and is substantially symmetrical about a central axis that is substantially perpendicular to a direction of movement of the cam plate along the rail. The gate system also includes a cam follower configured to follow the guide element as the cam plate slides along the rail and a gate assembly coupled to the cam follower.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Embodiments of the present disclosure are directed to gate systems that may be used in theme park environments to control crowd flow and access to attractions. It is now recognized that some existing gate systems may have inefficiencies related to the force requirements for holding gates in certain positions (e.g., open, closed or partially open)

and/or actuating the gates (e.g., opening and closing). Accordingly, present embodiments employ a cam plate that may facilitate opening and closing the gate and/or mechanically locking the gate in open and closed positions, thereby avoiding inefficient use of power/force to adjust the gate and/or to maintain certain positions.

As discussed in more detail below, present embodiments may be employed in different configurations (e.g., right or left arrangements) by merely repositioning component parts. For example, present embodiments can switch from a right-handed to a left-handed configuration. Present embodiments may enable adjustment of required forces in both the open and closed positions (with one changing the other). Further, the design of present embodiments is ambidextrous and can be installed in a parallel or perpendicular orientation relative to a guest path. The present embodiments may also provide a compact gate system that does not block or interfere with guest pathways.

Figure 1:
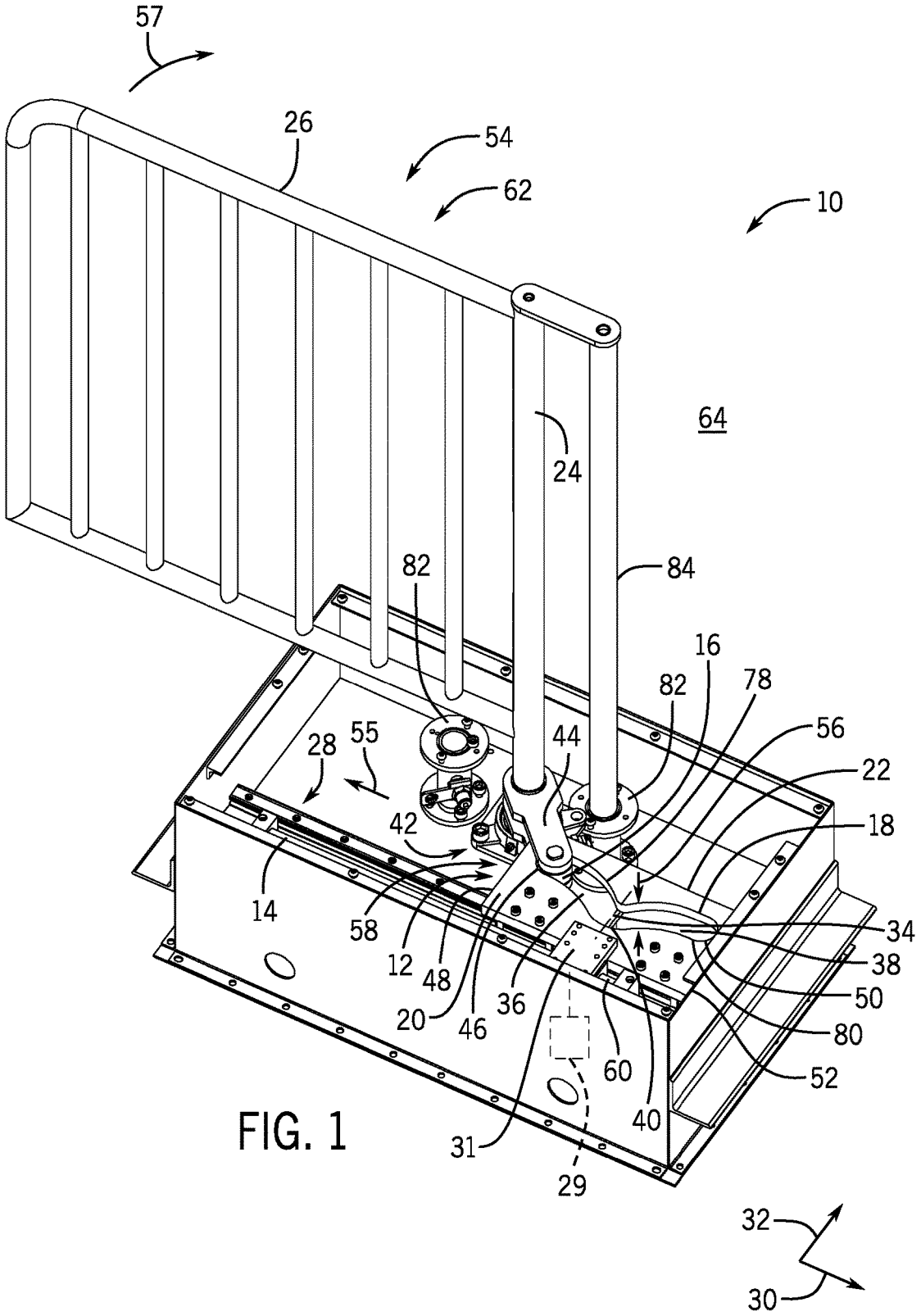
FIG. 1 is a perspective view of a gate system, wherein a cam sled is in a first end position, in accordance with an embodiment of the present disclosure.

FIG. 1 illustrates an embodiment of a gate system 10 (e.g., cam locking shotgun gate system). As shown, the gate system 10 includes a cam sled 12 (e.g., cam assembly) that is configured to slide along a rail 14 (e.g., rod, guide, or cylinder) and a cam follower 16 (e.g., track follower, roller, or bearing) that is configured to slide within a groove 18 (e.g., guide element, track, slot, recess) of a cam plate 20 (e.g., panel) of the cam sled 12. In the illustrated embodiment, a gate post 24 is coupled to the cam follower 16 via a coupling assembly 42, which may include a bracket 44 that is coupled to the cam follower 16 and to the gate post 24 (e.g., via respective fasteners, such as threaded fasteners). As discussed in more detail below, in operation, the cam sled 12 is driven to slide along the rail 14, and the cam follower 16 follows the groove 18, which causes the gate post 24 and attached guard 26 of a gate assembly 54 to rotate or actuate (e.g., open or close). For example, with reference to FIG. 1, the cam sled 12 may be driven to slide along the rail 14 in the direction of arrow 55, thereby causing the gate post 24 and the attached guard 26 of the gate assembly 54 to rotate in the direction of arrow 57.

It should be appreciated that the cam follower 16 and the cam plate 20 may have any of a variety of configurations that enable the cam follower 16 to engage and be guided by the cam plate 20. In particular, the cam plate 20 may include any suitable guide element (e.g., groove, track, slot, recess, ridge, protrusion, or the like), and the cam follower 16 may include a corresponding engaging feature (e.g., roller, bearing, recess, or the like). For example, in one embodiment, the cam plate 20 may include a ridge (e.g., protrusion) and the cam follower 16 may include a recess (e.g., groove) that engages the ridge of the cam plate 20 and that enables the cam follower 16 to track or be guided by the ridge of the cam plate 20, which causes the gate post 24 and the attached guard 26 of the gate assembly 54 to rotate. It should also be noted that the cam sled 12 and other moving parts may be positioned below a floor or covering, and thus, may be hidden from view and not visible to a guest or operator. In the illustrated embodiment, the floor or covering is not shown or is transparent to facilitate observation of the moving parts. Further, to facilitate discussion, the gate system 10 and its components may be described with reference to an axial axis or direction 30 and a lateral axis or direction 32.

In the illustrated embodiment, the rail 14 is part of a rodless cylinder 28 and extends along the axial axis 30. The rodless cylinder 28 may be pneumatically, hydraulically, or electrically actuated via a power source or supply 29. In particular, the power supply 29 may drive a carrier 31 (e.g., slide or bracket), which is slideably mounted about the rail 14 and is coupled to the cam plate 20 (e.g., via one or more fasteners, such as threaded fasteners) to facilitate movement of the cam plate 20 along the rail 14. In the illustrated embodiment, the groove 18 is substantially symmetrical about a central axis 34 (e.g., parallel to the lateral axis 32). In particular, the portion of the groove 18 through which the cam follower 16 travels during operation of the gate system 10 is substantially symmetrical about the central axis 34, and thus, a path followed by the cam follower 16 as the gate post 24 and the attached guard 26 of the gate assembly 54 to rotate between the open and closed positions is substantially symmetrical about the central axis 34. As shown, the groove 18 is a generally curved groove (e.g., parabolic or non-linear) having a first curved portion 36 on one side of the central axis 34 and a second curved portion 38 on another side of the central axis 34. The first curved portion 36 curves (e.g., gradually bends) between a central portion 40 (e.g., mid-point) that is positioned along the central axis 34 and a first axial end portion 46 proximate to a first axial edge 48 of the cam plate 20 relative to the axial axis 30. The second curved portion 38 curves (e.g., gradually bends) between the central portion 40 and a second axial end portion 50 proximate to a second axial edge 52 of the cam plate 20 relative to the axial axis 30. The first curved portion 36 and the second curved portion 38 curve away from a first lateral edge 22 of the cam plate 20 that is nearest the gate post 24 that the gate system 10 is configured to actuate, such that the axial end portions 46, 50 of the groove 18 are proximate to the first lateral edge 22 and the central portion 40 of the groove 18 are distal (e.g., further or relatively far) from the first lateral edge 22 in the lateral direction 32. In the illustrated embodiment, a width 56 of the groove 18 is substantially similar between the first and the second curved portions 36, 38 of the groove 18.

As shown in FIG. 1, the cam sled 12 is in a first end position 58 in which the cam plate 20 is proximate to a first end 60 of the rail 14 and/or the cam follower 16 is proximate to and/or in contact with the first end portion 46 of the groove 18. In the illustrated embodiment, the guard 26 of the gate assembly 54 is in an open position 62 in which the guard 26 is generally parallel to the axial axis 30 while the cam sled 12 is in the first end position 58, thereby enabling access for guests to travel through or across the gate assembly 54 along a guest path 64.

Figure 2:
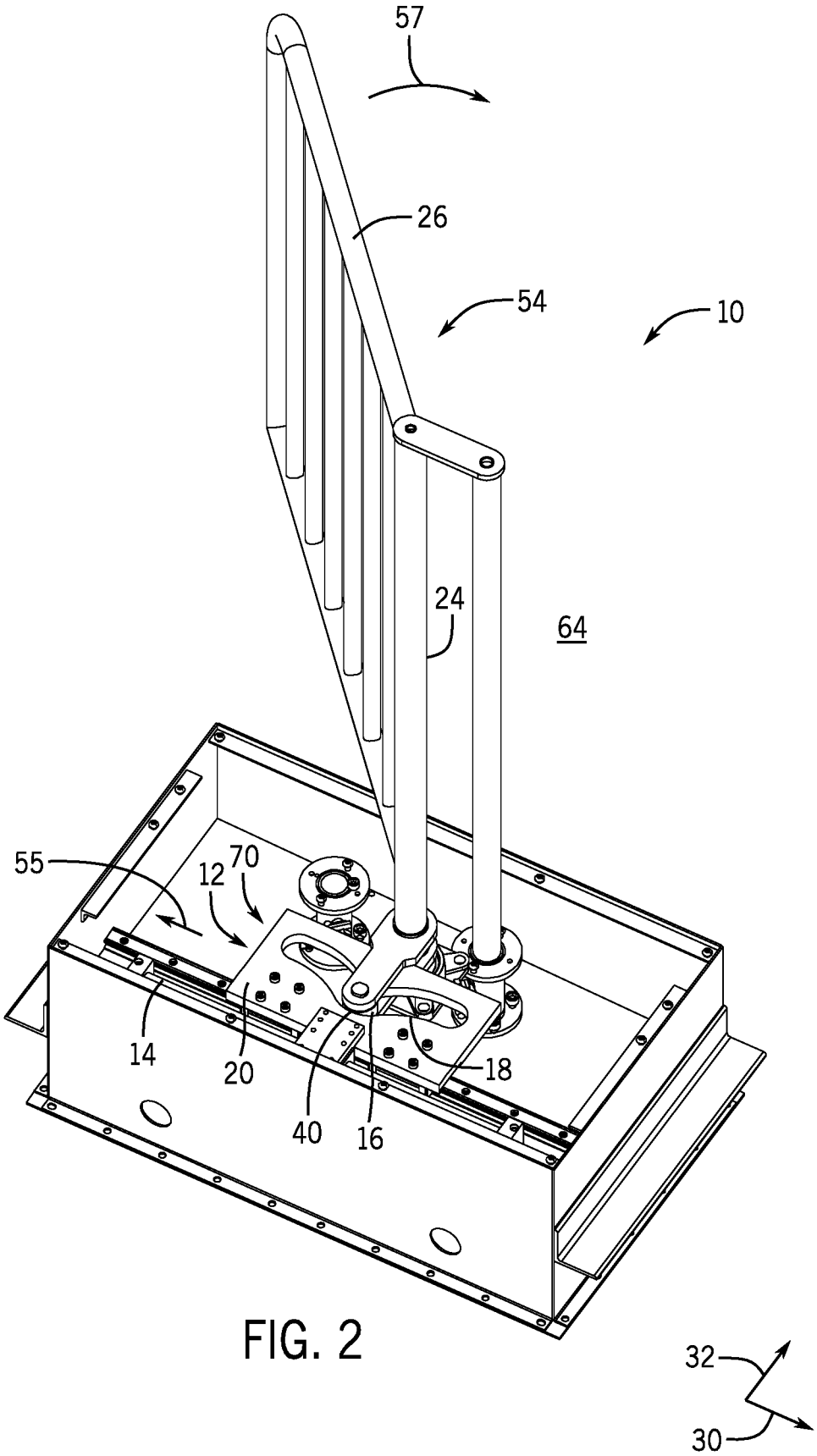
FIG. 2 is a perspective view of the gate system of FIG. 1, wherein the cam sled is in an intermediate position, in accordance with an embodiment of the present disclosure.
Figure 3:
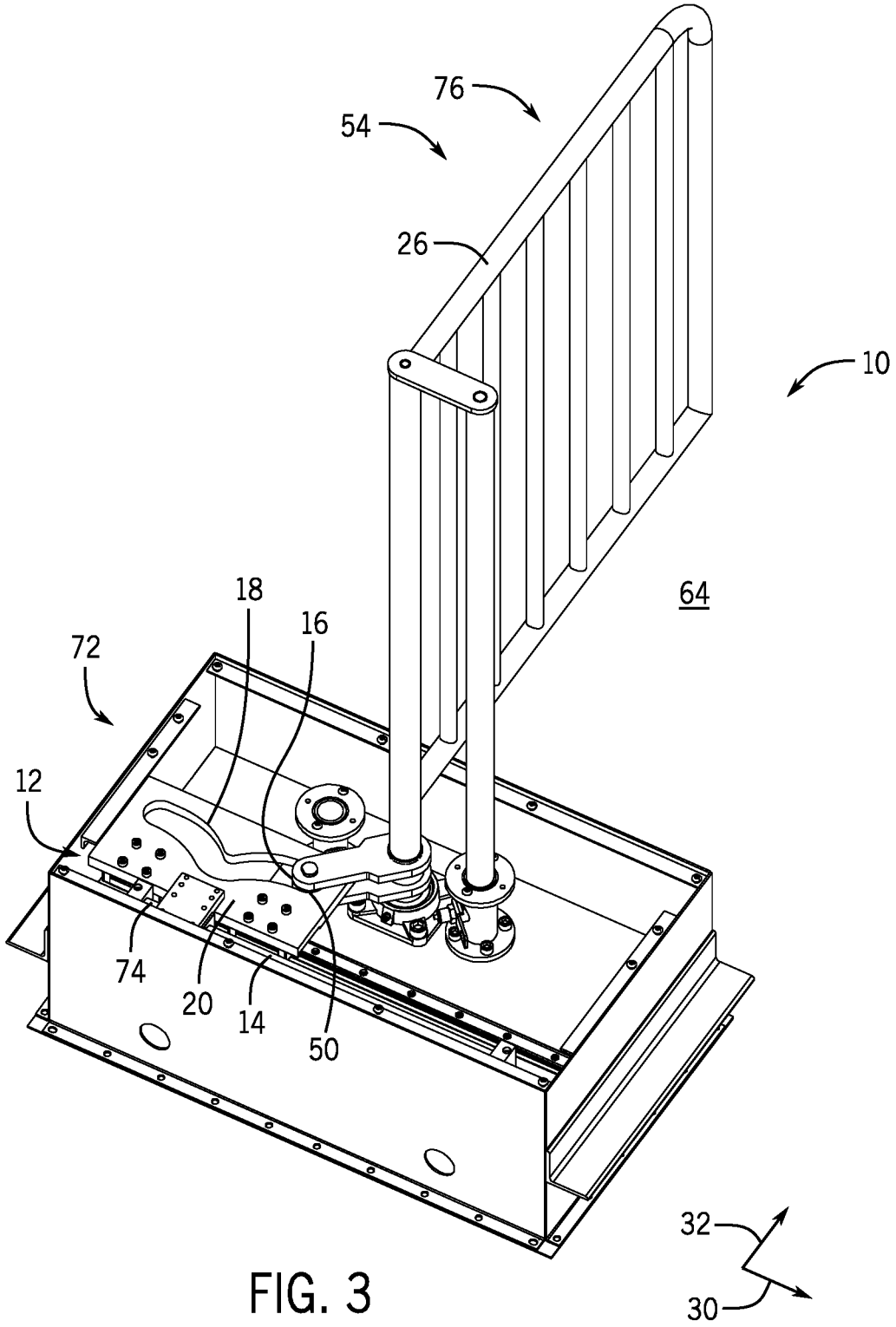
FIG. 3 is a perspective view of the gate system of FIG. 1, wherein the cam sled is in a second end position, in accordance with an embodiment of the present disclosure.

FIG. 2 is a perspective view of the gate system 10, wherein the cam sled 12 is in an intermediate position 70 (e.g., between the first end position 58 and a second end position) along the rail 14. FIG. 3 is a perspective view of the gate system 10, wherein the cam sled 12 is in a second end position 72 in which the cam plate 20 is proximate to a second end 74 of the rail 14 and/or the cam follower 16 is proximate to and/or in contact with the second end portion 50 of the groove 18. In the illustrated embodiment, the guard 26 of the gate assembly 54 is in a closed position 76 in which the guard 26 is generally parallel to the lateral axis 32 while the cam sled 12 is in the second end position 72, thereby blocking passage through or across the gate assembly 54 along the guest path 64. Thus, the gating system 10 is configured to drive rotation of the gate post 24 and the guard 26 of the gate assembly 54 through an angle (e.g., approximately 90 degrees) to enable or to block access for passage of guests along the guest path 64.

With reference to the embodiment illustrated in FIGS. 1-3, in operation, the cam plate 20 may be driven along the rail 14 from the first end position 58 to the second end position 74 in the direction of arrow 55. As the cam plate 20 moves along the rail 14, a curved surface 78 of the groove 18 may contact and drive (e.g., push) the cam follower 16, thereby driving rotation of the bracket 44 and the gate post 24 in the direction of arrow 57. When the cam plate 20 reaches the intermediate position 70, the cam follower 16 is in the center portion 40 of the groove 18 and the bracket 44 and the gate post 24 have rotated through an angle (e.g., approximately 45 degrees). As the cam plate 20 continues to move along the rail 14, a curved surface 80 of the groove 18 may contact and drive (e.g., pull) the cam follower 16, thereby driving further rotation of the bracket 44 and the gate post 24 in the direction of arrow 57. Similarly, movement of the cam plate 20 along the rail 14 from the second end position 74 to the first end position 58, drives the gate assembly 54 from the closed position 76 to the open position 62. In this manner, the cam plate 20 facilitates rotation of the gate post 24 and the guard 26 of the gate assembly 54 and moves the gate assembly 54 between the open position 62 and the closed position 76. In an embodiment, when the cam plate 20 has fully traversed the rail 14 in either direction (e.g., reached the first end position 58 or the second end position 72), the cam plate 20 mechanically locks into position, and further force application may be avoided with respect to maintaining the position of the gate post 24 and the guard 26.

It should be appreciated that the guard 26 may be attached to the gate post 24 in any of a variety of manners or orientations. For example, in an embodiment, the guard 26 may be attached to the gate post 24 such that the guard 26 is parallel to the lateral axis 32 when the cam sled 12 is in the first end position 58 and is parallel to the axial axis 30 when the cam sled 12 is in the second end position 72. To facilitate adjustment of the gate assembly 54, the gate system 10 may include one or more support structures 82 (e.g., post-receiving openings) that are configured to receive and to support a support post 84 of the gate assembly 54. For example, in FIG. 1, the support post 84 is supported within one support structure 82 on one axial side of the gate post 24; however, the gate assembly 54 may be adjusted relative to the cam sled 12, such that the support post 84 is supported within another support structure 82 on an opposite axial side of the gate post 24.

Figure 4:
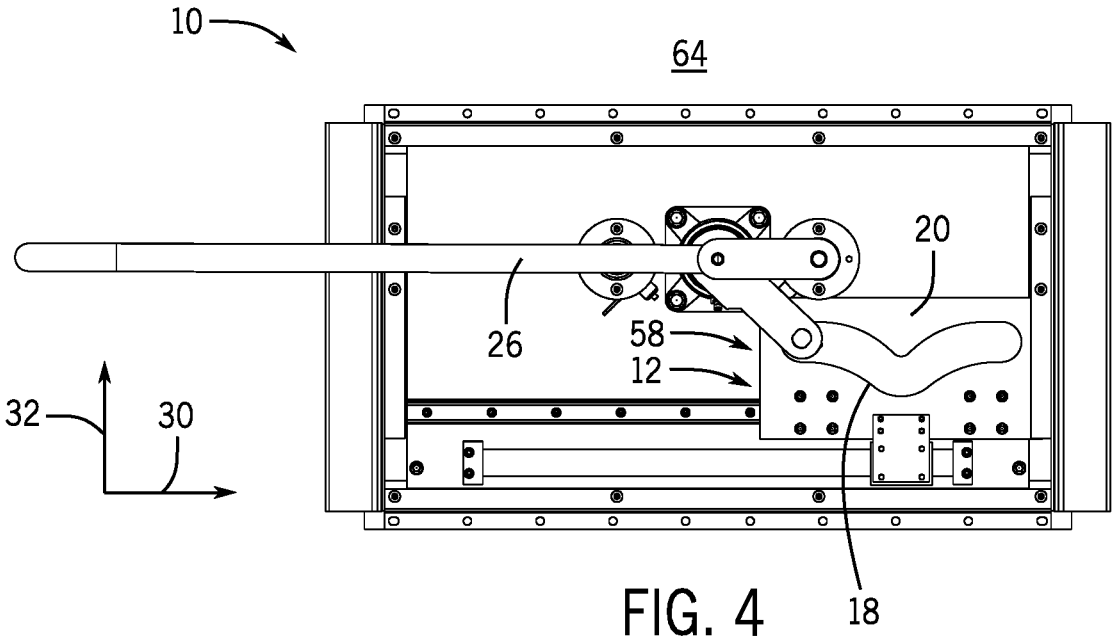
FIG. 4 is a top view of the gate system of FIG. 1, wherein the cam sled is in the first end position, in accordance with an embodiment of the present disclosure.
Figure 5:
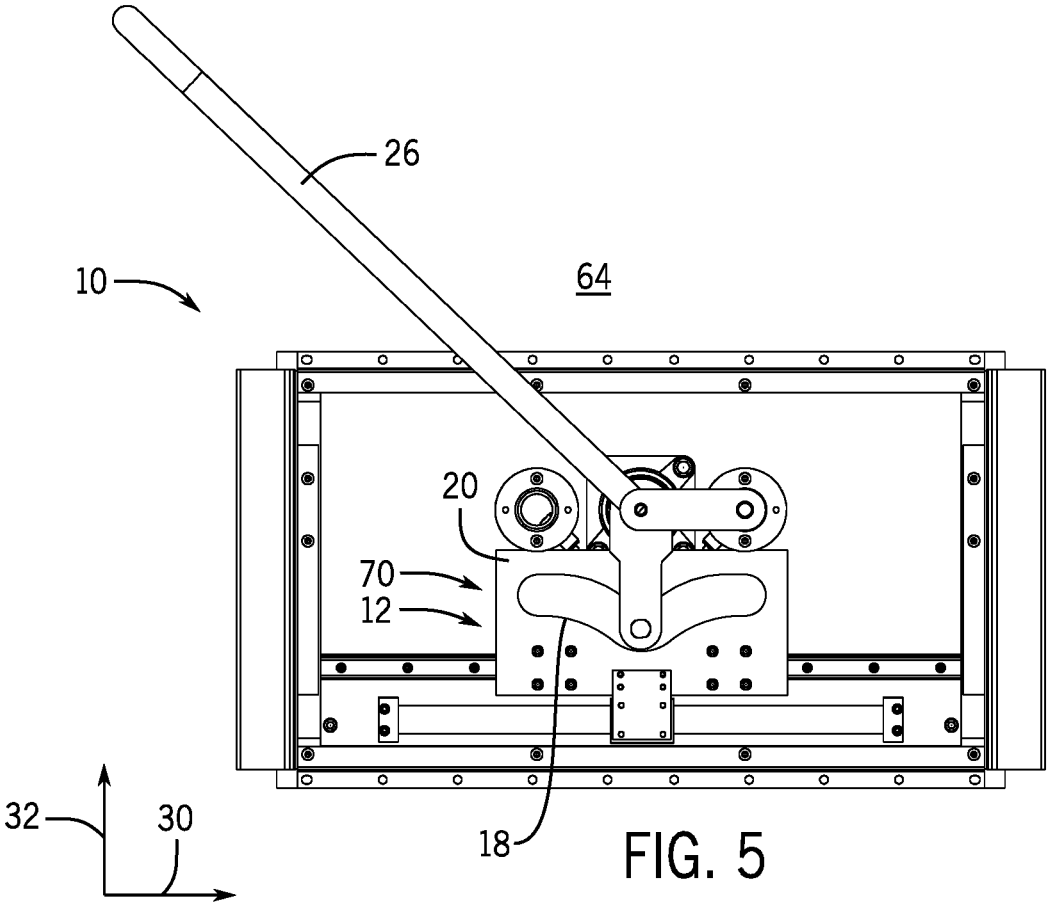
FIG. 5 is a top view of the gate system of FIG. 1, wherein the cam sled is in the intermediate position, in accordance with an embodiment of the present disclosure.
Figure 6:
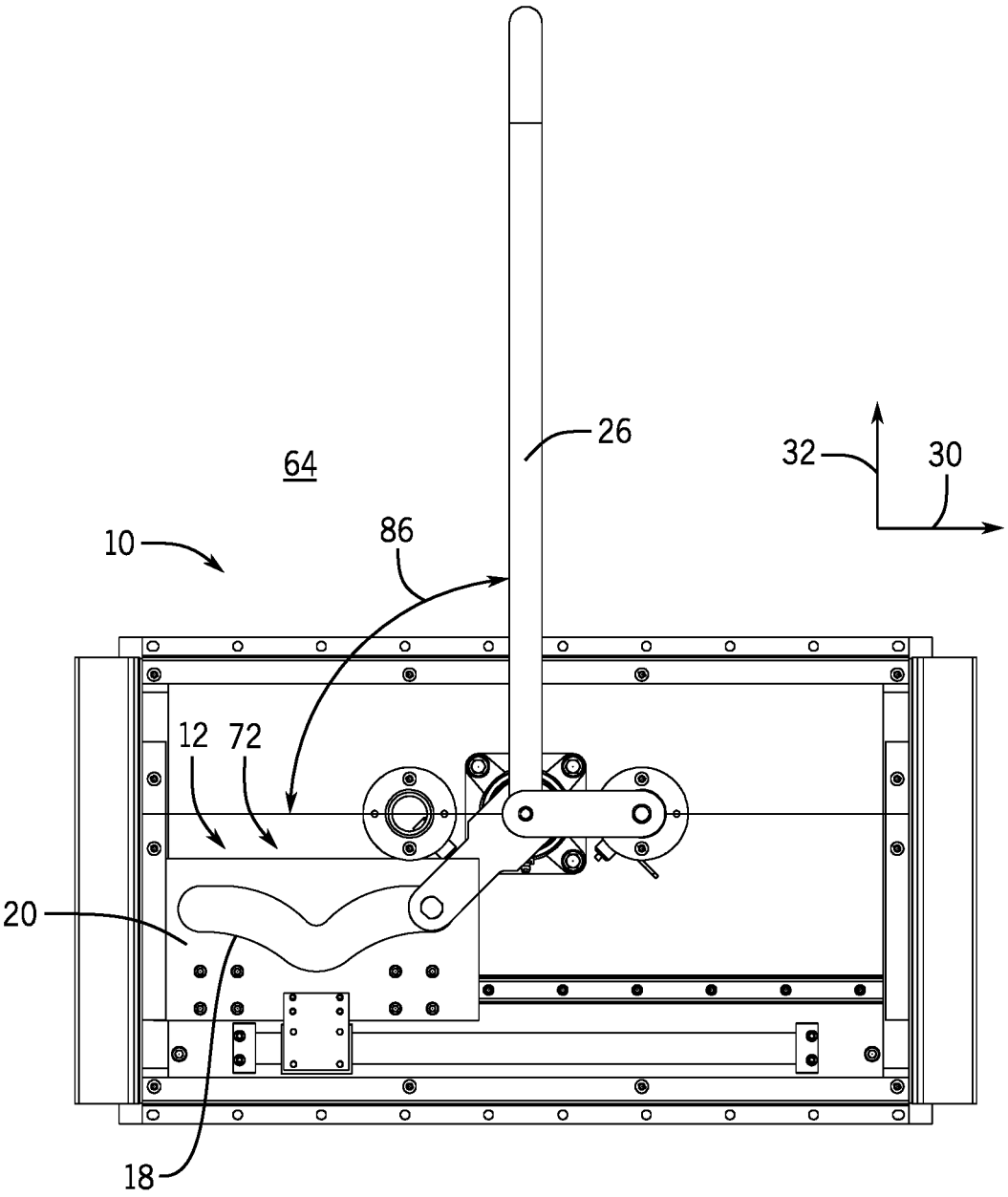
FIG. 6 is a top view of the gate system of FIG. 1, wherein the cam sled is in the second end position, in accordance with an embodiment of the present disclosure.

FIG. 4 is a top view of the gate system 10, wherein the cam sled 12 is in the first end position 58. FIG. 5 is a top view of the gate system 10, wherein the cam sled 12 is in the intermediate position 70. FIG. 6 is a top view of the gate system 10, wherein the cam sled is in the second end position 72. The gate system 10 illustrated in FIGS. 4-6 may include some or all of the features described above with respect to FIGS. 1-3. Additionally, as shown in FIGS. 4-6, movement of the cam sled 12 between the first end position 58 and the second end position 72 drives rotation of the bracket 44, the gate post 24, and the guard 26 through an angle 86 (e.g., approximately 90 degrees).

Figure 7:
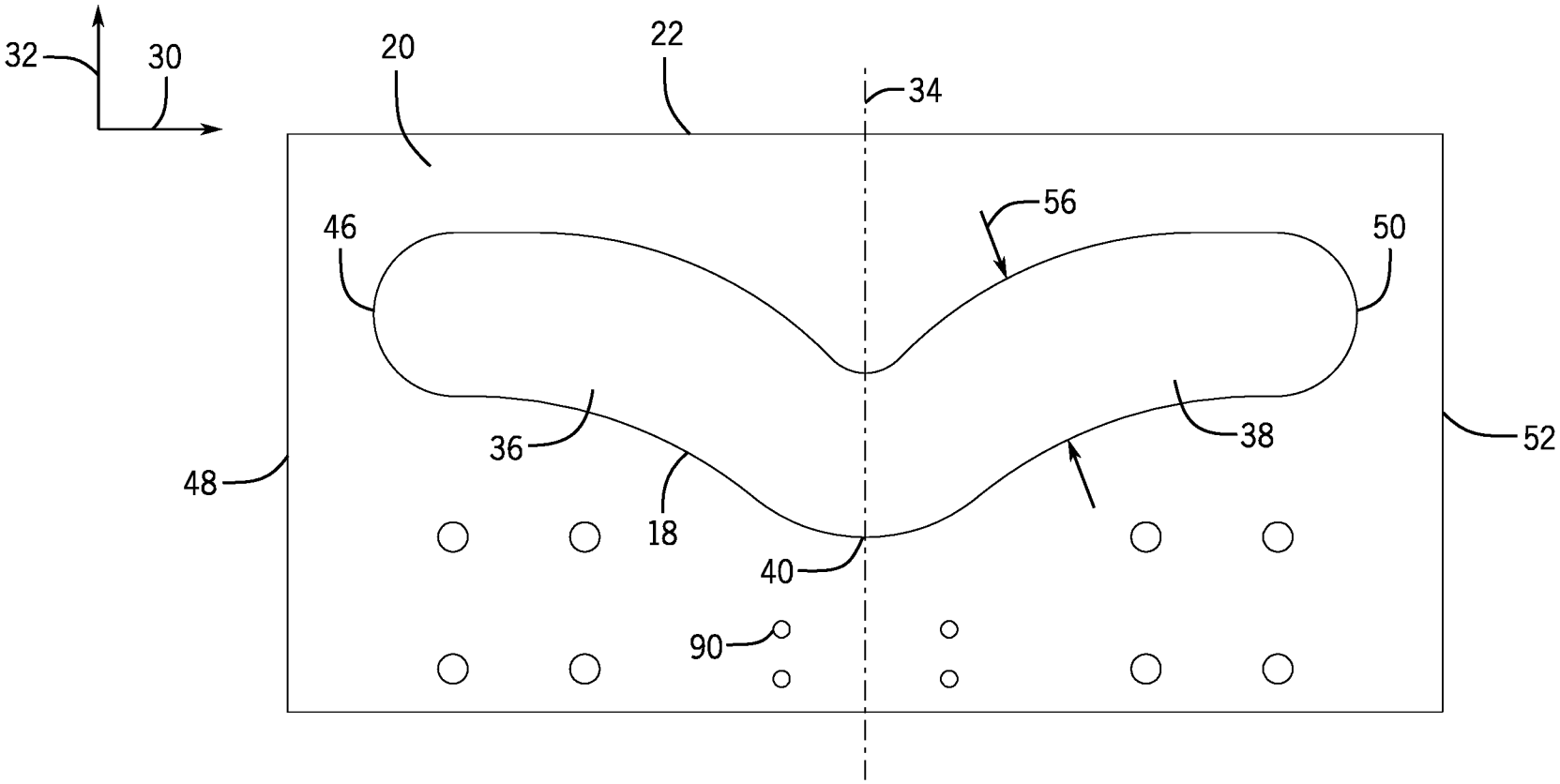
FIG. 7 is a top view of a cam plate having a curved groove that may be used in the gate system of FIG. 1, in accordance with an embodiment of the present disclosure.

FIG. 7 is a top view of the cam plate 20 having the groove 18, wherein the groove 18 is a generally curved groove. As described above with respect to FIG. 1, the groove 18 is substantially symmetrical about the central axis 34. As shown, the groove 18 is a generally curved groove having the first curved portion 36 and the second curved portion 38 that form a generally v-shaped profile. The first curved portion 36 curves between the central portion 40 and the first axial end portion 46 proximate to the first axial edge 48 of the cam plate 20. The second curved portion 38 curves between the central portion 40 and the second axial end portion 50 proximate to the second axial edge 52 of the cam plate 20. The first curved portion 36 and the second curved portion 38 curve away from the first lateral edge 22 of the cam plate 20, such that the axial end portions 46, 50 of the groove 18 are proximate to the first lateral edge 22 and the central portion 40 of the groove 18 is distal (e.g., further or relatively far) from the first lateral edge 22 in the lateral direction 32. In the illustrated embodiment, the width 56 of the groove 18 is substantially similar along the length of the groove 18 between the first and the second axial end portions 46, 50 of the groove 18. As shown, the cam plate 20 includes openings 90 that are configured to receive fasteners to couple the cam plate 20 to the carrier 31 and/or to other support structures, for example. However, other means known in the art for coupling the cam plate 20 to the carrier 31 may be used (e.g., welding, adhesive bonding, etc.). The groove 18 of the cam plate 20 may have any of a variety of configurations or profiles (e.g., shapes), which may in turn affect an angle of rotation (e.g., angle 86) of the gate assembly 54, as well as force requirements, smoothness, stability, speed, and/or acceleration of the gate assembly 54 as the gate assembly 54 rotates between the open position 62 and the closed position 76, as shown in FIGS. 1-6.

Figure 8:
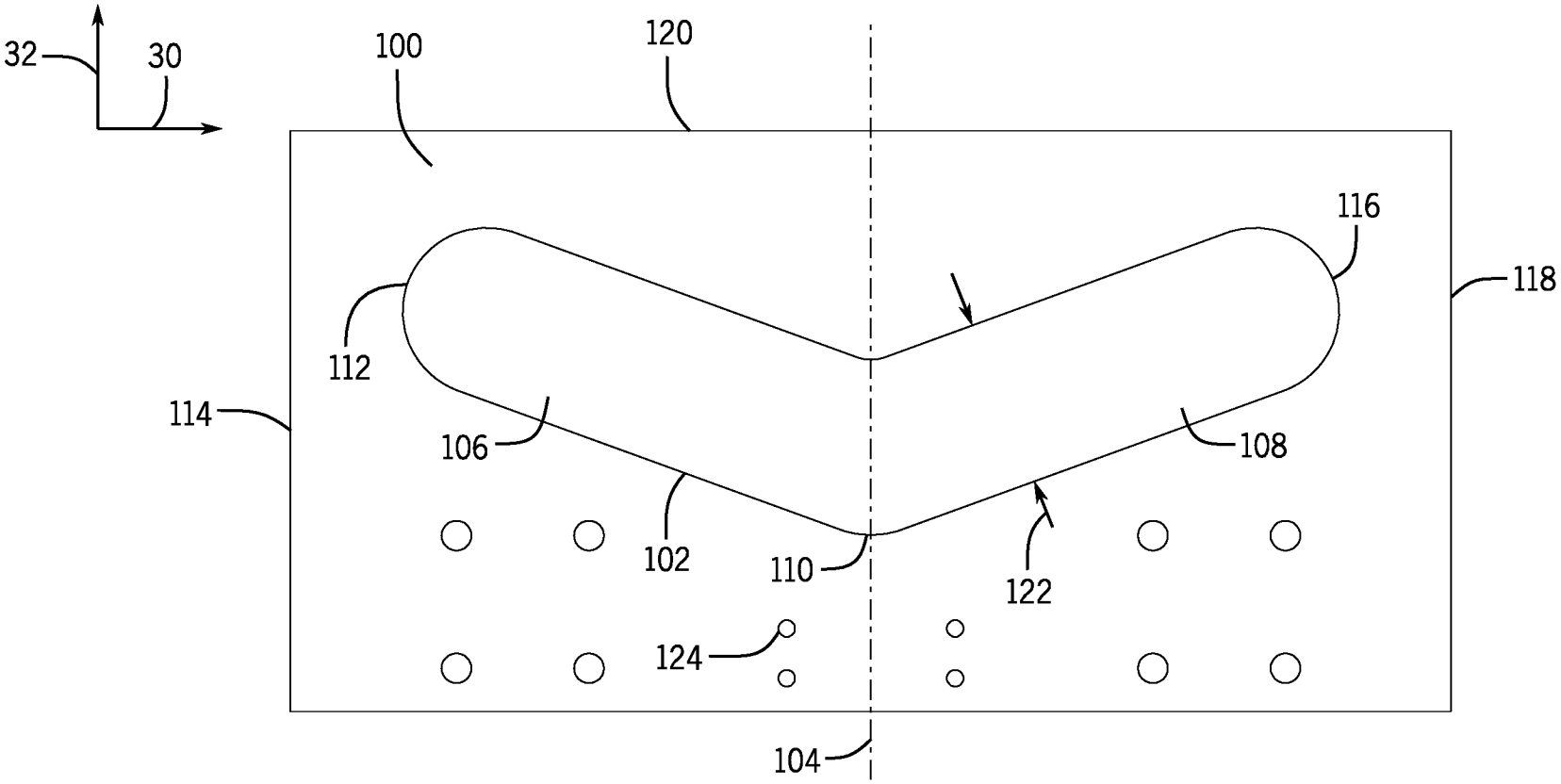
FIG. 8 is a top view of a cam plate having a linear groove that may be used in the gate system of FIG. 1, in accordance with an embodiment of the present disclosure.

With the foregoing in mind, FIG. 8 is a top view of an embodiment of a cam plate 100 having a linear groove 102 that may be used in the gate system 10. The cam plate 100 may have any of the features of the cam plate 20 discussed above with respect to FIGS. 1-3. For example, the cam plate 100 may be configured to slide along the rail 14 to cause the gate assembly 54 to move between the open position 62 and the closed position 76. As shown in FIG. 8, the groove 102 is substantially symmetrical about a central axis 104 (e.g., parallel to the lateral axis 32) and has a generally v-shaped profile. As shown, the groove 102 is a generally linear groove having a first linear portion 106 (e.g., straight or non-curved portion) on one side of the central axis 104 and a second linear portion 108 (e.g., straight or non-curved portion) on another side of the central axis 104. The first linear portion 106 extends between a central portion 110 (e.g., mid-point) and a first axial end portion 112 proximate to a first axial edge 114 of the cam plate 100. The second linear portion 108 extends between the central portion 110 and a second axial end portion 116 proximate to a second axial edge 118 of the cam plate 100. The first linear portion 106 and the second linear portion 108 extend away from a first lateral edge 120 of the cam plate 100, such that the first and second axial end portions 112, 116 of the groove 102 are proximate to the first lateral edge 120 and the central portion 110 of the groove 102 is distal (e.g., further or relatively far) from the first lateral edge 120 in the lateral direction 32. In the illustrated embodiment, a width 122 of the groove 102 is substantially similar along the length of the groove 102 between the first and the second axial end portions 112, 116 of the groove 102. As shown, the cam plate 100 includes openings 124 that are configured to receive fasteners to couple the cam plate 100 to the carrier 31 and/or to other support structures of the gate system 10, for example. However, other means known in the art for coupling the cam plate 20 to the carrier 31 may be used (e.g., welding, adhesive bonding, etc.).

Figure 9:
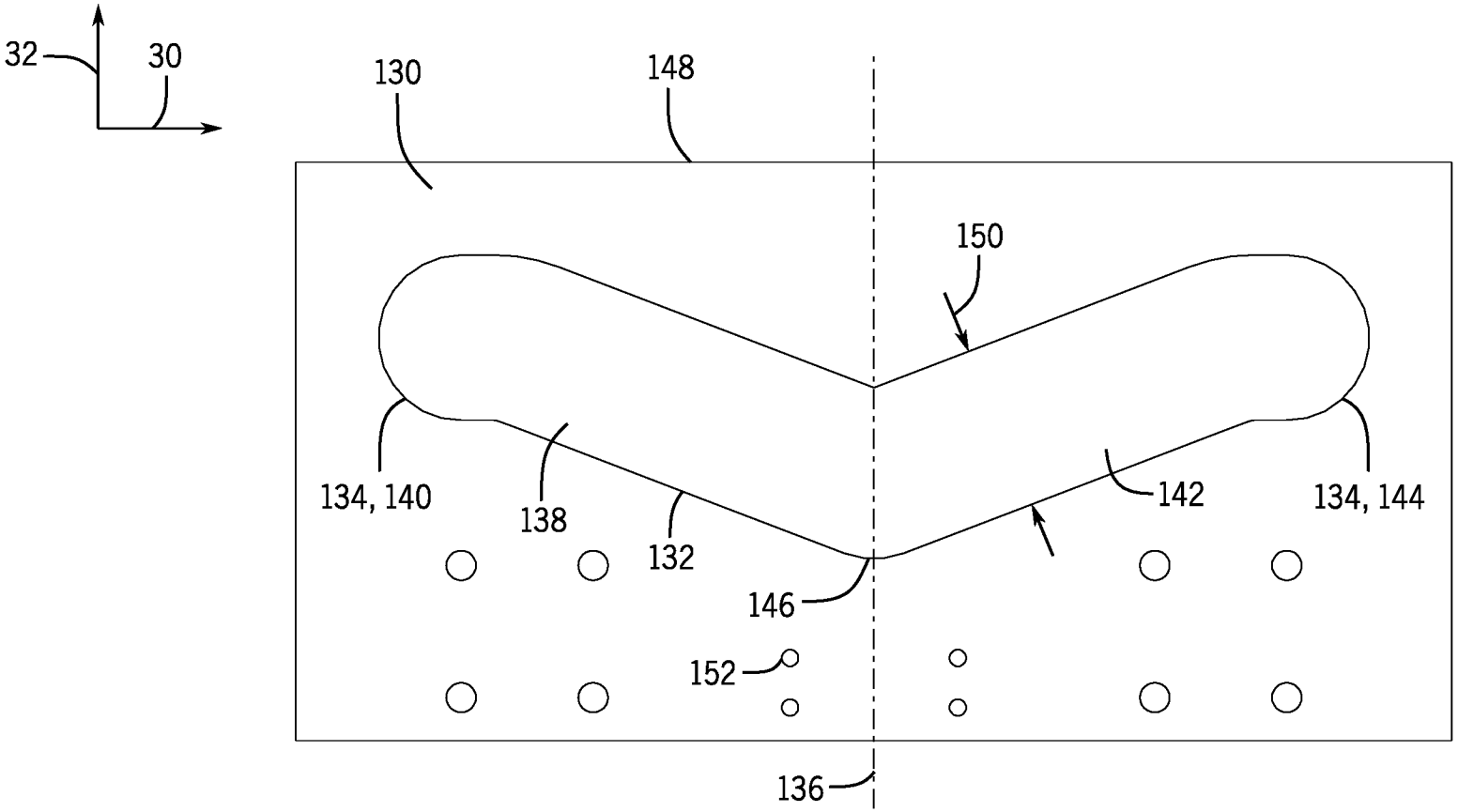
FIG. 9 is a top view of a cam plate having a linear groove with angled end portions that may be used in the gate system of FIG. 1, in accordance with an embodiment of the present disclosure.

FIG. 9 is a top view of an embodiment of a cam plate 130 having a linear groove 132 with end portions 134 (e.g., axially-extending end portions) that may be used in the gate system 10. The cam plate 130 may have any of the features of the cam plate 20 discussed above with respect to FIGS. 1-3. For example, the cam plate 130 may be configured to slide along the rail 14 to cause the gate assembly 54 to move between the open position 62 and the closed position 76. As shown in FIG. 9, the groove 132 is substantially symmetrical about a central axis 136 (e.g., parallel to the lateral axis 32) and forms a generally v-shaped profile. As shown, the groove 132 is a generally linear groove having a first linear portion 138 and respective end portion 134, 140 on one side of the central axis 136 and a second linear portion 142 and respective end portion 134, 144 on another side of the central axis 136. The groove 132 includes a central portion 146 (e.g., mid-point). The first linear portion 138 and the second linear portion 142 extend away from a first lateral edge 148 of the cam plate 130, such that the end portions 134 of the groove 132 are proximate to the first lateral edge 148 and the central portion 146 of the groove 132 is distal (e.g., further or relatively far) from the first lateral edge 148 in the lateral direction 32. In the illustrated embodiment, a width 150 of the groove 132 is substantially similar along the length of the groove 132 between the end portions 134 of the groove 132. As shown, the cam plate 130 includes openings 152 that are configured to receive fasteners to couple the cam plate 130 to the carrier 31 and/or to other support structures of the gate system 10, for example. However, other means known in the art for coupling the cam plate 20 to the carrier 31 may be used (e.g., welding, adhesive bonding, etc.).

Figure 10:
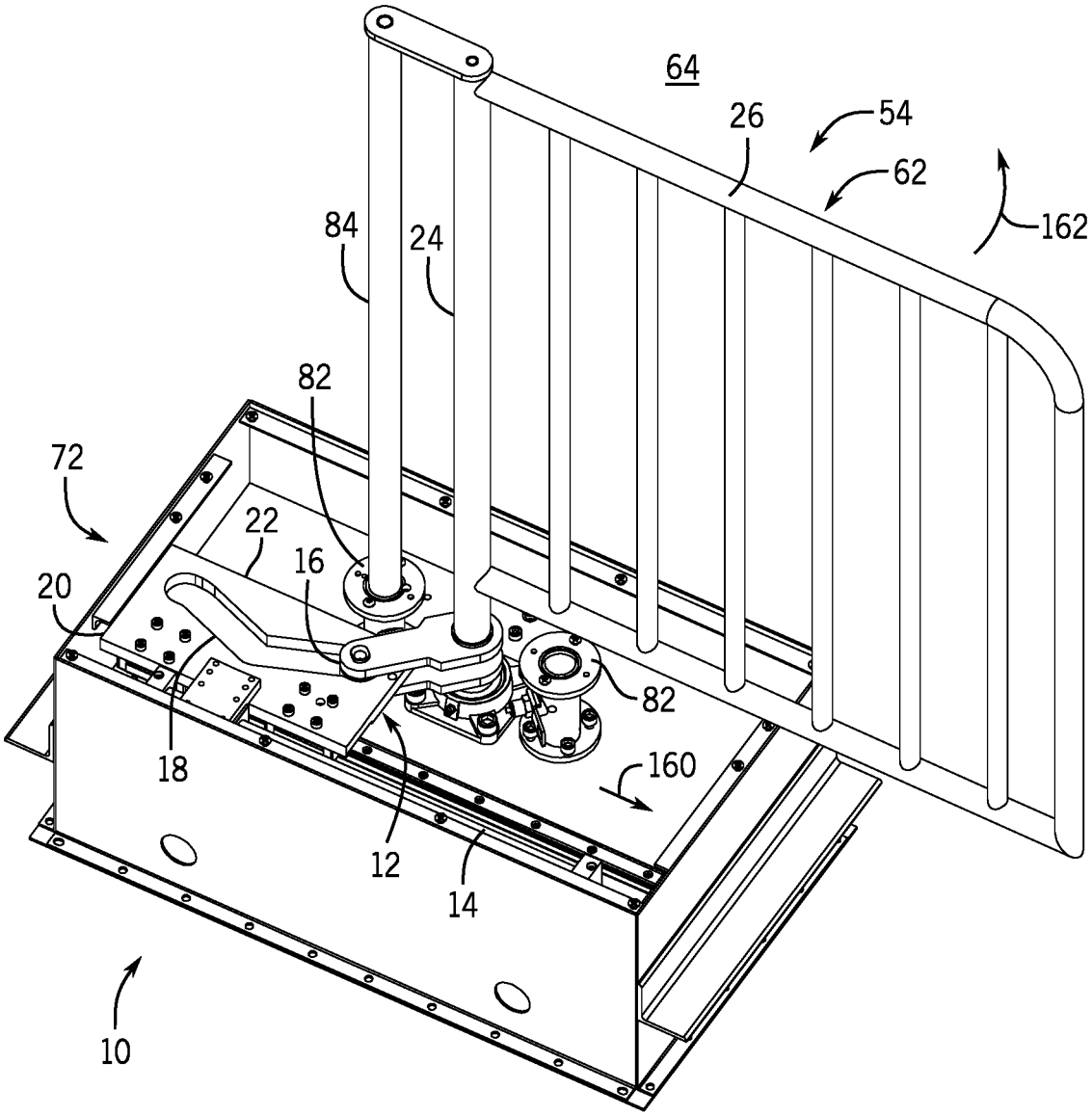
FIG. 10 is a perspective view of the gate system of FIG. 1, wherein the gate is arranged in a different orientation relative to the cam sled, in accordance with an embodiment of the present disclosure.

As noted above, components of the gate system 10 may be arranged in various configurations. For example, FIG. 10 is a perspective view of the gate system 10 of FIG. 1, wherein the guard 26 of the gate assembly 54 is positioned in a different orientation relative to the cam sled 12 as compared to FIG. 1. As shown, the guard 26 is in the open position 62 in which the guard does not block access to the guest path 64 while the cam sled 12 is in the second position 72. As the cam sled 12 moves from the second position 72 toward the first position 58 (shown in FIG. 1) in the direction of arrow 160, the guard 26 rotates in the direction of arrow 162 to a closed position in which the guard 26 blocks access to the guest path 64. As discussed above, to facilitate adjustment of the gate assembly 54, the gate system 10 may include one or more support structures 82 that are configured to receive and to support the support post 84 of the gate assembly 54. For example, in FIG. 1, the support post 82 is supported within one support structure 84, and in FIG. 10, the support post 82 is supported within another support structure 84.

The present disclosure is not limited in its application to the details of construction and arrangements of the components set forth herein. Variations and modifications of the foregoing are within the scope of the present disclosure. The present disclosure extends to all alternative combinations of two or more of the individual features mentioned or evident from the text and/or the drawings. All of these different combinations constitute various alternative aspects of the present disclosure. The embodiments described herein explain the best modes known for practicing the invention and will enable others skilled in the art to utilize the invention. While only certain features of the present disclosure have been illustrated and described herein, many modifications and changes will occur to those skilled in the art. It is, therefore, to be understood that the appended claims are intended to cover all such modifications and changes as fall within the true spirit of the present disclosure.

The invention claimed is:

1. A gate system comprising:

a cam sled comprising a cam plate configured to slide along a rail;

a cam follower engaged with a guide element of the cam plate; and a bracket comprising a first end portion and a second end portion, wherein the first end portion is configured to be non-rotatably coupled to a gate post and the second end portion is coupled to the cam follower;

wherein the cam sled is configured to be actuated by a power source to slide along the rail, thereby causing the cam follower to be guided along the guide element and causing the bracket to rotate about a single axis and mechanically lock into position in first or second orientations.

2. The gate system of claim 1, wherein the guide element comprises a curved profile.

3. The gate system of claim 1, wherein the guide element comprises a generally v-shaped profile.

4. The gate system of claim 1, wherein the guide element is substantially symmetrical about a central axis that is perpendicular to a direction of movement of the cam plate along the rail.

5. The gate system of claim 1, wherein the guide element comprises a groove, and the cam follower comprises a bearing that fits within the groove.

6. The gate system of claim 1, wherein the cam sled is configured to be actuated by the power source to slide along the rail, thereby causing the bracket to rotate about the single axis through an angle of approximately 90 degrees.

7. The gate system of claim 1, comprising the gate post, wherein the first end portion of the bracket is non-rotatably coupled to the gate post.

8. A gate system, comprising:

a gate assembly comprising a gate post;

a bracket comprising a first end portion that is non-rotatably coupled to the gate post and a second end portion;

a cam plate configured to slide along a rail and comprising a guide element; and a cam follower coupled to the second end portion of the bracket and engaged with the guide element of the cam plate;

wherein movement of the cam plate along the rail causes the cam follower to be guided along the guide element of the cam plate and causes the gate assembly to rotate about a single axis between an open position to enable access through the gate assembly and a closed position to block access through the gate assembly.

9. The gate system of claim 8, wherein the guide element comprises a curved profile.

10. The gate system of claim 8, wherein the guide element comprises a generally v-shaped profile.

11. The gate system of claim 8, wherein the cam follower is configured to move along a path that is substantially symmetrical about a central axis as the gate assembly rotates between the open position and the closed position.

12. The gate system of claim 11, wherein the central axis is substantially perpendicular to a direction of movement of the cam plate along the rail.

13. The gate system of claim 11, wherein the guide element comprises a first curved portion on a first side of the central axis, a second curved portion on a second side of the central axis, and a central portion along the central axis between the first curved portion and the second curved portion, and wherein the first curved portion and the second curved portion curve away from a lateral edge of the cam plate such that respective ends of the first curved portion and the second curved portion are proximate to the lateral edge and the central portion is distal from the lateral edge.

14. The gate system of claim 11, comprising a plurality of support structures configured to receive the gate post of the gate assembly, wherein the gate assembly is in a first orientation relative to the cam plate when the gate post is received and supported within a first support structure of the plurality of support structures and the gate assembly is in a second orientation relative to the cam plate when the gate post is received and supported within a second support structure of the plurality of support structures.

15. A gate system configured to adjust between an open position and a closed position to enable and to block travel along a path on a floor surface, the gate system comprising:

a cam plate comprising a guide element, wherein the cam plate is configured to slide along a rail relative to the floor surface between a first end position and a second end position, and wherein the guide element comprises a generally v-shaped profile and is substantially symmetrical about a central axis that is substantially perpendicular to a direction of movement of the cam plate along the rail;

a cam follower configured to follow the guide element as the cam plate slides along the rail; and a gate assembly coupled to the cam follower, wherein the gate assembly is configured to rotate to adjust the gate system between the open position and the closed position as the cam follower follows the guide element as the cam plate slides along the rail.

16. The gate system of claim 15, wherein the guide element comprises a first curved portion on a first side of the central axis and a second curved portion on a second side of the central axis.

17. The gate system of claim 15, wherein the guide element comprises a first substantially linear portion on a first side of the central axis and a second substantially linear portion on a second side of the central axis.

18. The gate system of claim 17, wherein the guide element comprises a first end portion angled relative to the first substantially linear portion and a second end portion angled relative to the second substantially linear portion.

19. The gate system of claim 15, wherein axial ends of the guide element are positioned proximal to a lateral edge of the cam plate that is proximate to a gate post of the gate assembly, and a central portion of the guide element is positioned distal from the lateral edge.

20. The gate system of claim 1, wherein the rail extends along a central axis from a first rail end and a second rail end, and the central axis is perpendicular to the single axis.

* * * * *